United States Patent [19]

Haimowitz

[11] 4,190,174

[45] Feb. 26, 1980

[54] DRINKING RECEPTACLE COVER WITH A LIP OPERATED VALVE

[75] Inventor: Irwin Haimowitz, Los Angeles, Calif.

[73] Assignee: Thermo-Seal, Inc., Los Angeles, Calif.

[21] Appl. No.: 7,396

[22] Filed: Jan. 29, 1979

[51] Int. Cl.[2] ..... A47G 19/22

[52] U.S. Cl. ..... 220/254; 220/90.4; 220/355; 229/7 R

[58] Field of Search ..... 220/254, 256, 90.4, 220/268, 90.2, 355; 229/7 R

[56] References Cited

U.S. PATENT DOCUMENTS

| | | | |
|---|---|---|---|
| 2,276,577 | 3/1942 | Hahn | 229/7 R |
| 3,905,512 | 9/1975 | Albert et al. | 220/90.4 |
| 3,952,910 | 4/1976 | Wheeler | 220/90.4 |
| 4,113,135 | 9/1978 | Yamazaki | 220/268 |

*Primary Examiner*—Allan N. Shoap
*Attorney, Agent, or Firm*—Don J. Flickinger

[57] ABSTRACT

A drinking receptacle cover comprises two layers of a rigid resilient material which are circular in shape. An annular downwardly opening channel is formed at the periphery of the two layers which are snugly assembled. This channel receives the top rim portion of a drinking receptacle, and to secure the assembled relation the outer wall of the channel is formed with an inwardly extending bead which engages said rim portion. Both layers have an opening adjacent to the channel. This opening is normally closed by a valve which is generally of the same shape as the opening and also comprises two layers. The lower layer comprises an inner vertical wall and two sidewalls which diverge towards the periphery and are joined at their outer ends by a curved endwall. These side and end walls are formed with a continuous outwardly extending flange. The top layer is also formed with an inner vertical wall, side walls diverging therefrom and a curved end wall. To increase the elastic memory of the valve the vertical wall of the top member has connected thereto reinforcing ribs, the ends of which are remote from the vertical wall and blend in with the circular wall of the cover.

5 Claims, 7 Drawing Figures

DRINKING RECEPTACLE COVER WITH A LIP OPERATED VALVE

The present invention relates to a cover for a drinking receptacle which includes a lip operated valve and is concerned primarily with a cover which is of a high degree of simplicity and is constructed to provide proper acuation of the lip operated valve for a long period of service usage.

BACKGROUND OF THE INVENTION

There is in the prior art at least one patent which is somewhat similar to the subject drinking cover, in that it includes a lip operated valve. Such a valve is opened by pressure applied by the upper lip of the user which depresses the valve thus permitting the contents of the receptacle to flow through the opening in a somewhat confined manner which inhibits splashing or spreading of the liquid content over the downward portion of the face of the drinker. When the upper lip is removed from the valve, the elastic memory of the wall structure which connects the valve to the top wall of the cover returns the valve to closed position. However, provision must be made to prevent the valve from moving upwardly beyond the closed position, which will occur when pressure is applied thereto by the liquid content of the receptacle. Thus there are several features which are of particular importance. The first is that the cover be readily manufactured to hold down the cost thereof. Secondly, the hinge like action of the inner vertical wall should be effective over a long period of time of service usage; and finally definite assurance must be had that the valve will not move upwardly beyond this closed position.

The closest prior art of which the applicant is aware is the patent of Albert et al U.S. Pat. No. 3,908,512 issued Sept. 16, 1975. The cover of this patent is essentially a one layer cover throughout its entire structure. The instant cover is of a two layer construction throughout its entire extent. This two layer construction presents one distinct advantage over the Albert et al patent in that production costs are held to a minimum. Another advantage resides in the double ply structure of the wall which provides the hinge like action. This double ply wall will in itself supply an elastic memory greater than that of a single ply structure. Moreover, this hinge like action which is generated by the resilient property of the material is susceptible of being enhanced by including supporting ribs which are integral with the vertical wall. It is also noted that the double layered construction of the valve member is particularly adapted to include a flange which positively limits upward or outward movement of the valve.

OBJECTS OF THE INVENTION

With the foregoing conditions in mind, the present invention has in view the following objectives:

1. To provide a cover for a drinking receptacle which includes a lip operated valve and which may be readily produced by low manufacturing costs.

2. To provide a drinking cover of the character aforesaid which comprises essentially two layers of a rigid material which has a property of resiliency to a high degree.

3. To provide a drinking receptacle cover of the type noted which includes a valve member or assembly which comprises two plies each of which is integrally joined to a layer of the cover.

4. To provide a drinking valve of the kind described in which each of the plies of the valve assembly includes a rear or inner wall which is normal to the flat top wall of the cover and from which extends diverging side walls which are joined at their outer ends by curved walls.

5. To provide a drinking valve of the type aforesaid in which the sidewalls of the lower ply of the valve assembly is formed with an outwardly extending flange which engages the underside of the top wall of the cover to limit outward movement of the valve member.

6. To provide in a drinking receptacle cover of the type noted a structure for increasing the elastic memory of the rear wall which provides the hingelike action which moves the valve to closed position.

Various other more detailed objects and advantages of the invention such as arise in connection with carrying out the above-noted ideas in a practical embodiment will in part become apparent and in part be hereinafter stated as the description of the invention proceeds.

SUMMARY OF THE INVENTION

The foregoing objects are achieved by providing a circular cover for a drinking receptacle which comprises two layers of a rigid resilient material such as any of the plastics now commonly used and available to the public for drinking receptacles and/or covers for the receptacle.

The cover is formed with an inwardly or downwardly opening channel at its periphery which receives the upper rim portion of a drinking receptacle and the outer wall which defines the channel.

The outer wall, which is a part of the cover construction is formed with a bead which cooperates with the upper rim portion of the drinking receptacle to hold the cover assembled thereon.

The cover includes a circular top wall and the inner wall of the channel construction which is extended out or above the periphery of this top wall.

Both layers of the top wall are formed with an opening defined by an inner or rear edge and diverging side edges, the outer ends of which are joined by a curved edge. This curved edge is closely adjacent to the periphery of the top wall. The flow of liquid through this opening is controlled by a valve member or assembly which also comprises two plies which are integrally joined to the top wall of the cover by a rear or inner end wall that is a chord of the circle defining the circular top wall.

The bottom ply of the valve includes sidewalls which diverge toward the periphery from the ends of the inner wall and are joined on their outer ends by a curved wall. A flange extends from the lower edges of the side and end walls and abuts the under surface of the top wall of the cover to prevent outward movement of the valve from its closed position.

The top ply also includes a rear wall, diverging sidewalls and a curved end wall the edges of which are integrally joined to the top layer of the top wall of the cover. At least one rib is formed integral with the rear wall of the top ply and gradually diminishes in extent to meld in with top layer of the cover.

The two layers of the cover including the plies of the valve assembly are snugly assembled in a closely nested position. In operation, the upper lip of a drinker is applied to the outer end portion of the valve to depress it and thus open the drinking opening in the cover. When the pressure of the lip is removed, the hinge like action of the rear wall which is closed by the elastic memory of the material from which the cover is made moves the valve in to position closing the drinking opening with the flange on the lower ply engaging the upper surface of the top wall of the cover to prevent the valve from moving outwardly or upwardly in relation to the top wall of the cover.

For a full and more complete understanding of the invention reference may be had to the following description and accompanying drawing, wherein.

DESCRIPTION OF A PREFERRED EMBODIMENT

Figure 1:
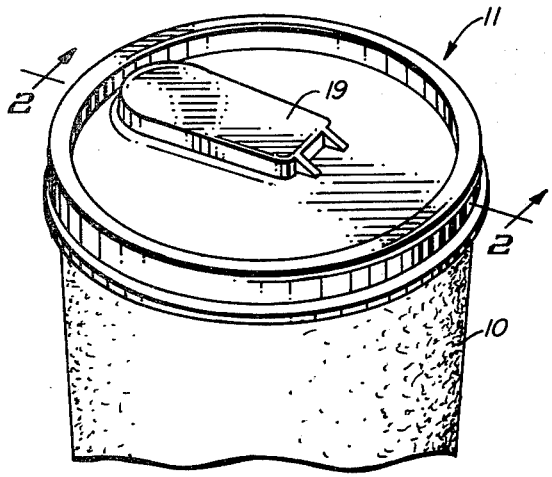
FIG. 1 is prospective of the upper portion of a drinking receptacle with a cover made in accordance with the precepts of this invention applied thereto.

Referring now to the drawing wherein like reference characters denote corresponding parts throughout the several views and first more particularly to FIG. 1 the upper portion of a drinking vessel is shown at 10. The portion of the receptacle 10 immediately adjacent to its open end or rim is formed with an element of a connection (not illustrated) which cooperates with a complemental element on a cover which is identified in its entirety by reference character 11. Cover 11 is of a material which possesses the properties of rigidity and resilience to a high degree. There are several plastics now known and available to the public which meet these requirements. This material should also be susceptible of being deformed into the required shape by presses or it may be molded in this shape. If it is desired this material may also be transparent to enable the drinker to look therethrough and determine the amount of liquid contained in receptacle 10.

Cover 11 comprises two layers which are closely nested in an interfitting relation. The top layer is designated 12 and the bottom layer 13. These layers when assembled constitute a flat top wall which is circular in shape and a channel structure designated generally 14 is formed integrally with the top wall at its periphery. Thus channel structure 14 is U-shaped in formation presenting an inner wall 15 and an outer wall 16. Outer wall 16 is formed with an integrally extending bead 17 which engages the rim portion of receptacle 10 when it is received into the channel to maintain the assembled relation.

Figure 5:
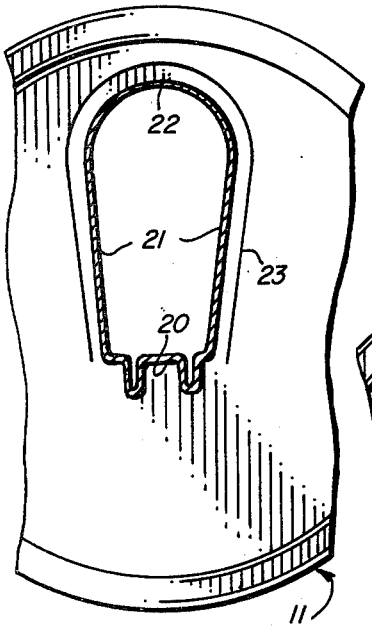
FIG. 5 is a horizontal section through the lower plies of the valve being taken on the plane of the line 5—5 of FIG. 2.
Figure 7:
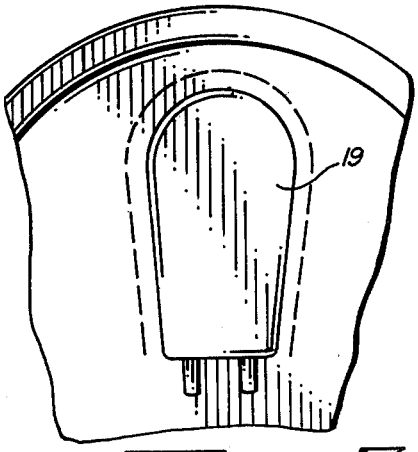
FIG. 7 is a top plan view of a portion of the cover illustrating the valve in closed position.

A drinking opening 18 is formed in the top wall 12–13 and its formation leaves material of both layers which together form a valve or valve assembly designated 19. This opening is defined by an inner straight edge which preferably is a chord of the circle which defines the top wall 12–13, diverging side edges which extend outwardly from ends of the inner edge and a curved outer edge. These edges are not designated by reference characters because it is believed that to do so would confuse the illustration of the drawing. However, referring now to FIGS. 3 and 5, the valve assembly includes an inner rear wall 20 which upstands from the inner straight edge of opening 18. Sidewall 21, the inner ends which are integral with the ends of wall 20 and a curved outer end wall 22. A flange 23 is coextensive with sidewall 21 and curved wall 22 and extend outwardly from the lower edges of these walls. This flange 23 engages the under surface of the lower layer of 13 of the top wall 12–13 to prevent outward or upward movement of the valve 19 which would move it into a position closing said drinking opening 18.

Figure 3:
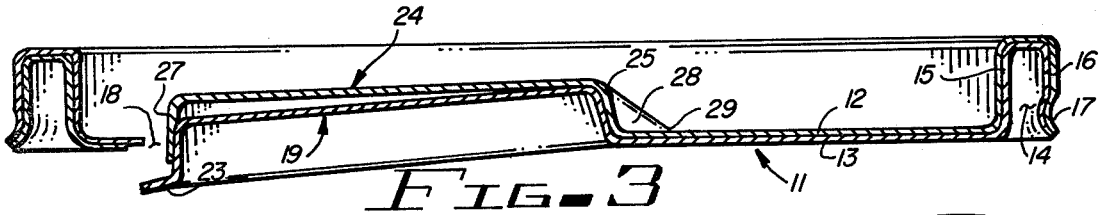
FIG. 3 is another diametric section similar to FIG. 2 showing the valve in open position.
Figure 6:
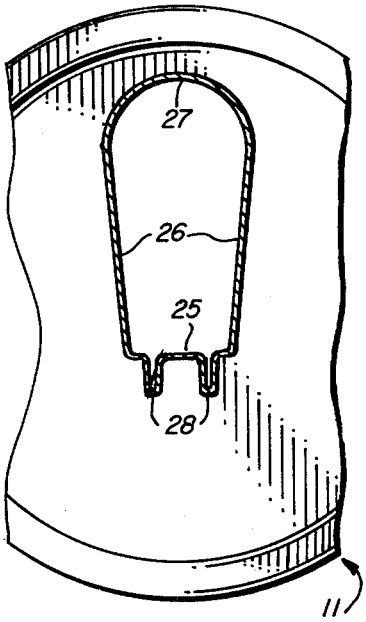
FIG. 6 is a section through the wall structure of the plies of the upper valve ply being taken on the plane of line 6—6 of FIG. 2.

Referring now, more particularly to FIGS. 3 and 6, the top ply of valve assembly 19 is designated generally 24. It comprises an inner wall 25 which overlies end wall 20, diverging sidewalls 26 and a curved end wall 27. The lower edges of walls 25, 26 and 27 are integral with the top ply 12 of the cover 11.

Under many conditions, rear wall 25 will have an elastic memory sufficient to provide the hingelike action which moves the valve 19 to closed position. However, if desirable elastic memory may be increased by a pair of ribs 28, ribs 28 are integral with rear wall 25 and spaced therealong where ribs 28 are joined to rear wall 25. The edges thereon joined to rear wall 25 are of substantially the same height as rear wall 25, however they gradually decrease in height to a point at 29 where they merge in with top layer 12 of cover 11.

OPERATION

Figure 4:
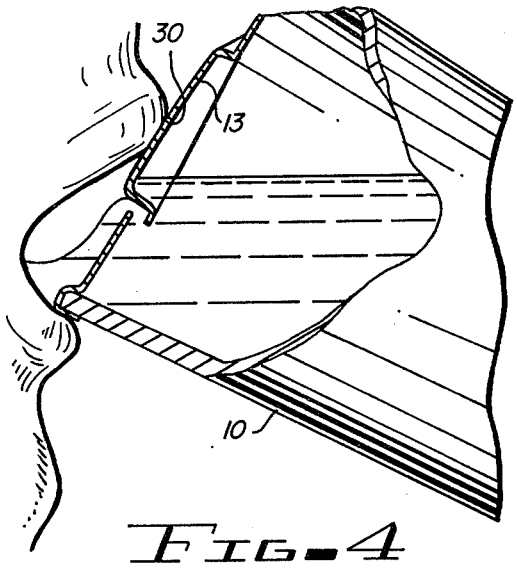
FIG. 4 is a perspective that is somewhat schematic depicting how the upper lip of a user is pressed against the valve to open the drinking opening in the cover.
Figure 2:
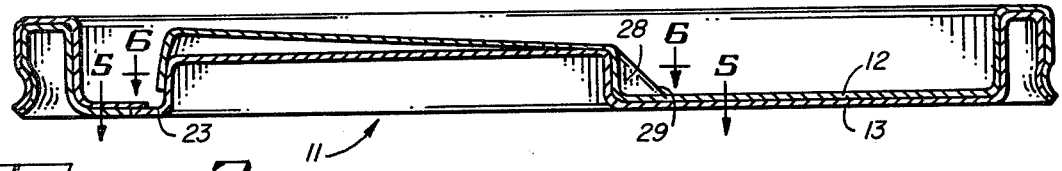
FIG. 2 is a diametric section through the cover taken on the plane of the line 2—2 of FIG. 1 and illustrating the valve in closed position but with the layers of the plies of the valve showing the layers of the valve in an exaggerated spaced relation to permit illustrating the construction more clearly.

FIG. 4 shows the upper lip 30 of a drinker engaging the top layer 12 of the top wall to move valve 19 to open position, when the lip is removed the elastic memory of rear wall 25 returns the valve to closed position.

While preferred specific embodiments of the invention are hereinbefore set forth, it is to be clearly understood that the invention is not to be limited to the exact mechanisms, constructions and devices illustrated and described because various modifications of these details may be provided in putting the invention into practice.

What is claimed is:

1. In a cover for a drinking receptacle having a lip operated valve, with the receptacle having an open top defined by a circular rim portion of the receptacle:

a. two thin layers of a rigid resilient material of circular formation presenting a circular periphery and snugly assembled in a nested relation;

b. a downwardly opening channel formed immediately adjacent to said periphery for receiving the rim portion of said receptacle;

c. both of said layers being formed with an opening defined by a straight edge margin proximate the center of the cover diverging side edges extending radially outwardly from the ends of said straight edge margin towards the periphery of the cover and a curved end edge between the side edges and located closely adjacent to the periphery of the cover;

d. the inner layer of said cover having a straight end wall upstanding integrally from the straight edge margin of the opening of said inner layer, side walls upstanding from adjacent the diverging side edges of said opening of said inner layer and a curved end wall upstanding from adjacent said curved end edge of said opening of said inner layer;

e. said side and curved walls being formed with a flange that is integral therewith and outstanding therefrom;

f. the top layer of said cover having a straight end wall upstanding integrally from the straight edge margin of the opening of the top layer, diverging side walls having ends integrally joined to the straight end wall of said top layer and a curved end wall integrally joined to the ends of said side walls more closely adjacent to the periphery of the cover; and g. said lower and upper layers of that portion of the cover in which the opening is formed constituting a two ply valve with the flange on the lower ply engaging the underside of the top layer of the cover when the valve is in closed position and said straight walls on the upper layer of said cover constituting a hinge which permits a downward movement of the valve when pressure is applied thereto by the lips of a drinker and the resiliency of the hinge returns the valve to closed position when the pressure of the drinkers lips is removed therefrom, with the return movement being limited by the engagement of said flange with the underside of said top layer.

2. The drinking recptacle cover of claim 1 in which a wall of said channel is formed with an inwardly extending bead which engages the rim portion of the receptacle to secure the assembled relation of the cover on the receptacle.

3. The drinking receptacle cover of claim 2 in which said channel is defined by walls which extend above the upper surface of the cover and the bead is formed in the outer of these walls.

4. The drinking receptacle cover of claim 1 in which both of the layers of the cover are of rigid resilient plastic.

5. The drinking receptacle cover of claim 1 in which a rib is integral with the straight wall of the upper ply of the valve and extends away therefrom to a site where it is integrally joined to said upper layer, said rib being effective to enhance the elastic memory of the hinge effect provided by the joining of said rear wall to upper layer.

* * * * *